US006439656B1

(12) United States Patent
Liu

(10) Patent No.: US 6,439,656 B1
(45) Date of Patent: Aug. 27, 2002

(54) FOLDING CHAIR CONVERTIBLE TO ROCKING CHAIR

(76) Inventor: Lausan Chung-Hsin Liu, No. 243, Chien-Kuo Rd., Hsin-Tien City, Taipei Hsien (TW)

( * ) Notice: Subject to any disclaimer, the term of this patent is extended or adjusted under 35 U.S.C. 154(b) by 0 days.

(21) Appl. No.: 09/824,097

(22) Filed: Apr. 3, 2001

(51) Int. Cl.[7] ..... A47C 3/02

(52) U.S. Cl. ..... 297/33; 297/32; 297/271.6; 297/272.1

(58) Field of Search ..... 297/32, 33, 272.1, 297/271.6

(56) References Cited

U.S. PATENT DOCUMENTS 179,949 A * 7/1876 Parker ..... 297/33
244,104 A * 7/1881 Andrews ..... 297/33
715,346 A * 12/1902 Brubaker ..... 297/33 X
1,317,580 A * 9/1919 Kanode ..... 297/272.1
4,126,353 A * 11/1978 Clough ..... 297/272.1
5,486,034 A * 1/1996 Dalke ..... 297/272.1 X

* cited by examiner

*Primary Examiner*—Anthony D. Barfield
(74) *Attorney, Agent, or Firm*—Bacon & Thomas, PLLC

(57) ABSTRACT

A folding chair convertible to a rocking chair enabling a folding chair converting to a rocking chair comprises pedestals located at four ends each engaged with a plurality of support bars to form a chair frame for supporting a backrest and seat pad thereon. A pair of rockers is provided beneath the folding chair. The rockers have respectively anchor seats mounted thereon to engage with the pedestals for the folding chair convertible to a rocking chair when desired.

3 Claims, 5 Drawing Sheets

PRIOR ART Fig. 1

FOLDING CHAIR CONVERTIBLE TO ROCKING CHAIR

BACKGROUND OF THE INVENTION

This invention relates to a folding chair that is convertible to a rocking chair and particularly a folding chair that has a set of rockers located thereunder for converting to a rocking chair.

In order to increase leisure functionality of a folding chair and to enable the chair equipping rocking function in addition to provide seating, there is a proposal of leisure chair disclosed for achieving this purpose as shown in FIG. 1. It generally has four fastening members fastened respectively to the front and rear support and two lateral supports of a leisure chair. Then a piece of canvas or cloth is disposed over the supports to form the seat pad and backrest to form a foldable and extensible leisure chair suitable for outdoor use. The fastening members may be mounted on a pair of curved slats and fastened thereon by bolts to convert the leisure chair become a rocking chair for adding comfort to people seating thereon. However such a design and construction still has drawbacks, notably:

1. Outdoor ground conditions are not always suitable for supporting rocking chair, such as a slope terrain, uneven graveled ground or road, or the like. It such an occasion, the curved slats have to be removed to convert the rocking chair back to the leisure chair to give user a steady and comfortable seating support. Users have to use tools to remove the bolts from the fastening members for disengaging the curved slats from supports of the chair. It is a tedious and time consuming chore. Even at the condition which the rocking chair may be used, the curved slats have relatively small contact area with the ground surface and result in not very stable support for people seating thereon. A slightly poor ground condition or lopsided seating of the user could topple the chair and hurts the user seating thereon, or damage the rocking chair. Therefore it needs people to take great care to safely seat thereon. The additional mental burden of seating and safety concern run counter to the leisure and relaxation purpose it is supposed to achieve.
2. The fastening members and curved slats are usually made by integral forming process. In order to reduce cost, most producers adapt an uniform specification. As a result, there are not many choices to attract consumers. To add more selections and appealing, many different molds have to be made and the cost will increase. How to make the rocking chair attractive and its production economically justified is a problem many furniture producers are facing now.
3. As the fastening members are fastened by bolts and done by user through tools, the curved slats are mostly made of hard wood. The wood is a more expensive material. The forming of the curved slat is a complicated process. Moreover, the wooden curved slat tends to wear off after using a period of time, and will result in unsightly appearance or uneven balance which may topple easily when seating people.

SUMMARY OF THE INVENTION

In view of aforesaid disadvantages, it is therefore an object of this invention to provide an improved structure that has anchor seats fastened to the rockers for holding the pedestals at four corners such that the folding chair is convertible to a rocking chair without changing the design of the pedestal, and users may select either the folding chair or rocking chair to suit their desires depends on the physical environments.

Another object of this invention is to provide a retainer for preventing the pedestal from detaching from the anchor seat, and an elastic element housed in the anchor seat to facilitate assembly and disassembly.

BRIEF DESCRIPTION OF THE DRAWINGS

The invention, as well as its many advantages, may be further understood by the following detailed description and drawings, in which.

DETAILED DESCRIPTION OF THE PREFERRED EMBODIMENT

Figure 1:
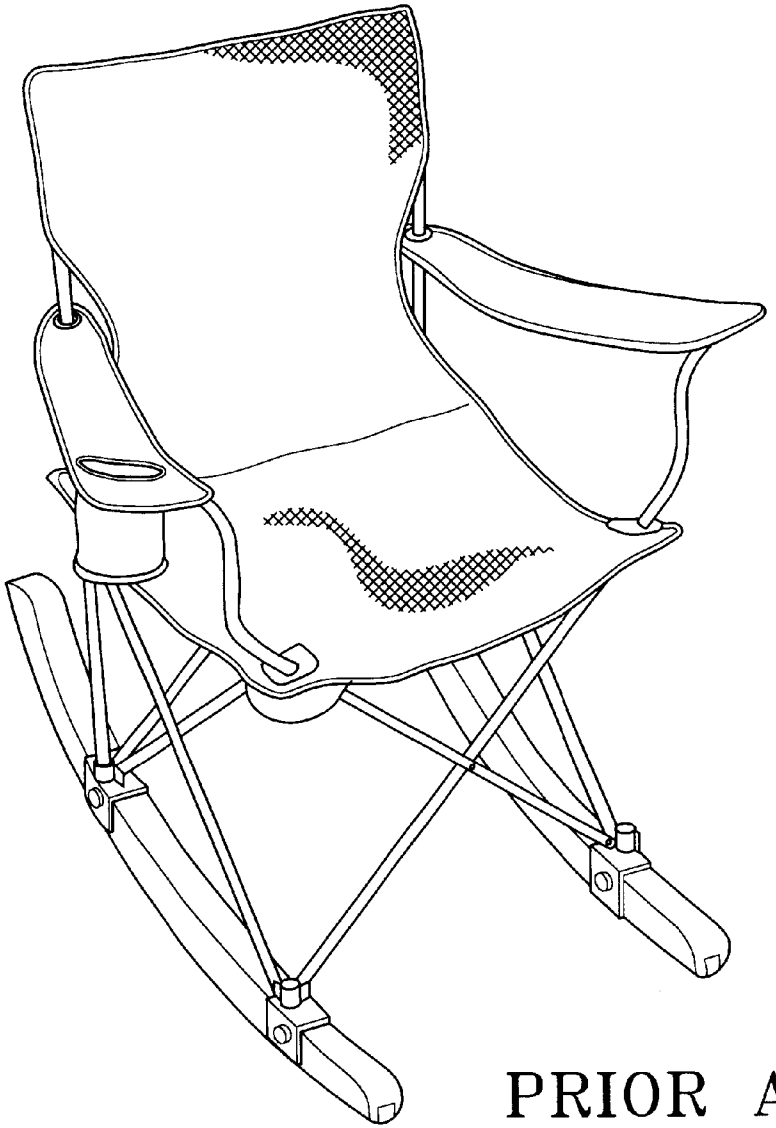
FIG. 1 is a perspective view of a conventional folding chair serving as a rocking chair.
Figure 2:
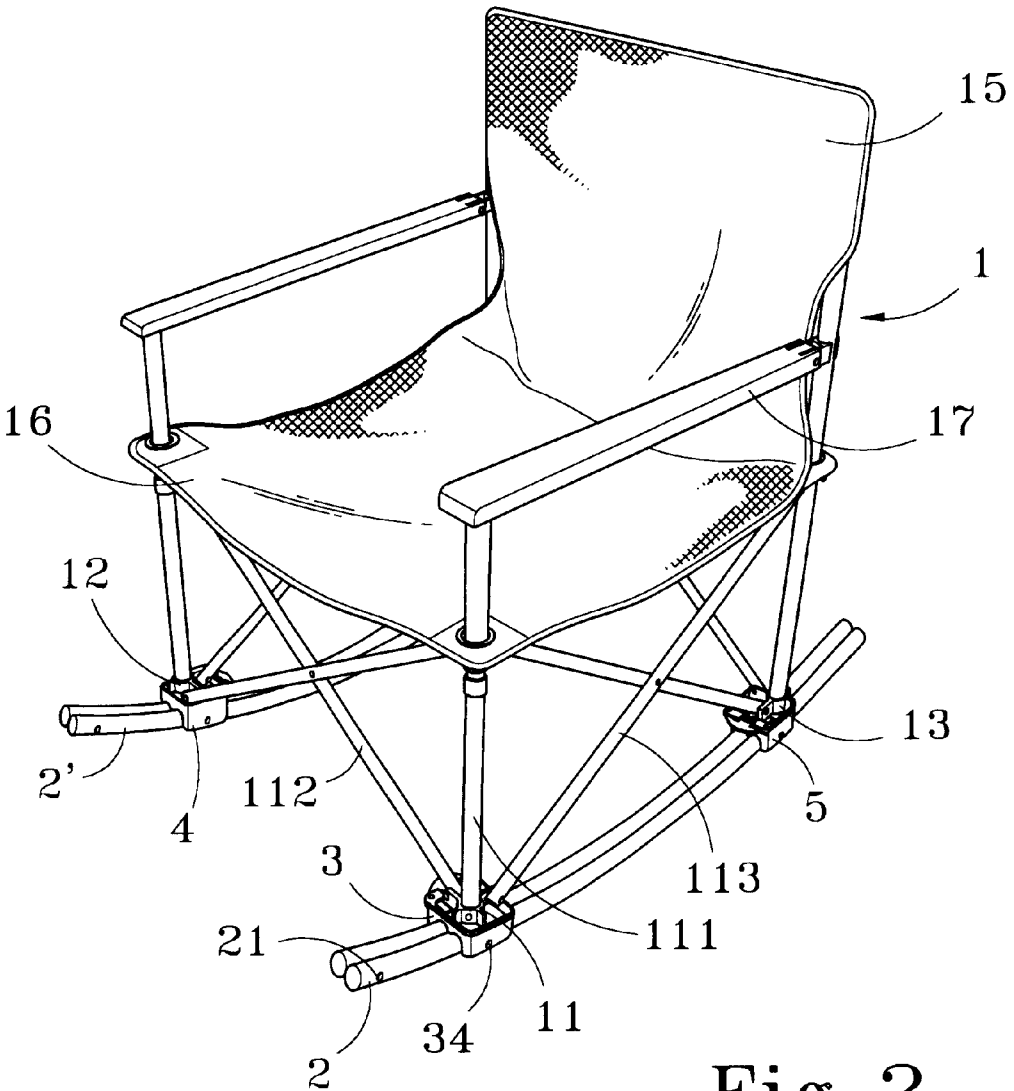
FIG. 2 is a perspective view of this invention.
Figure 3:
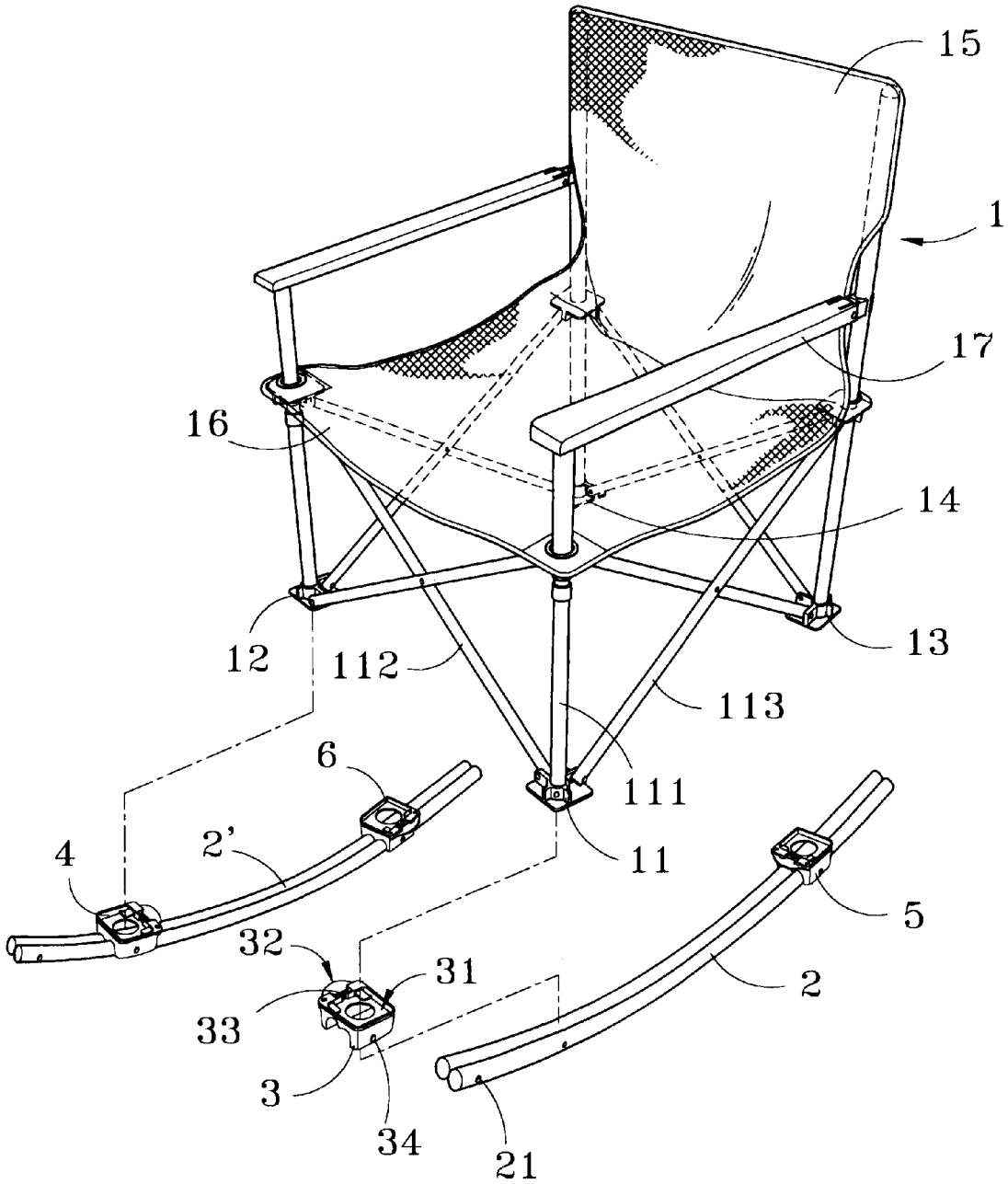
FIG. 3 is an exploded view of this invention.
Figure 5:
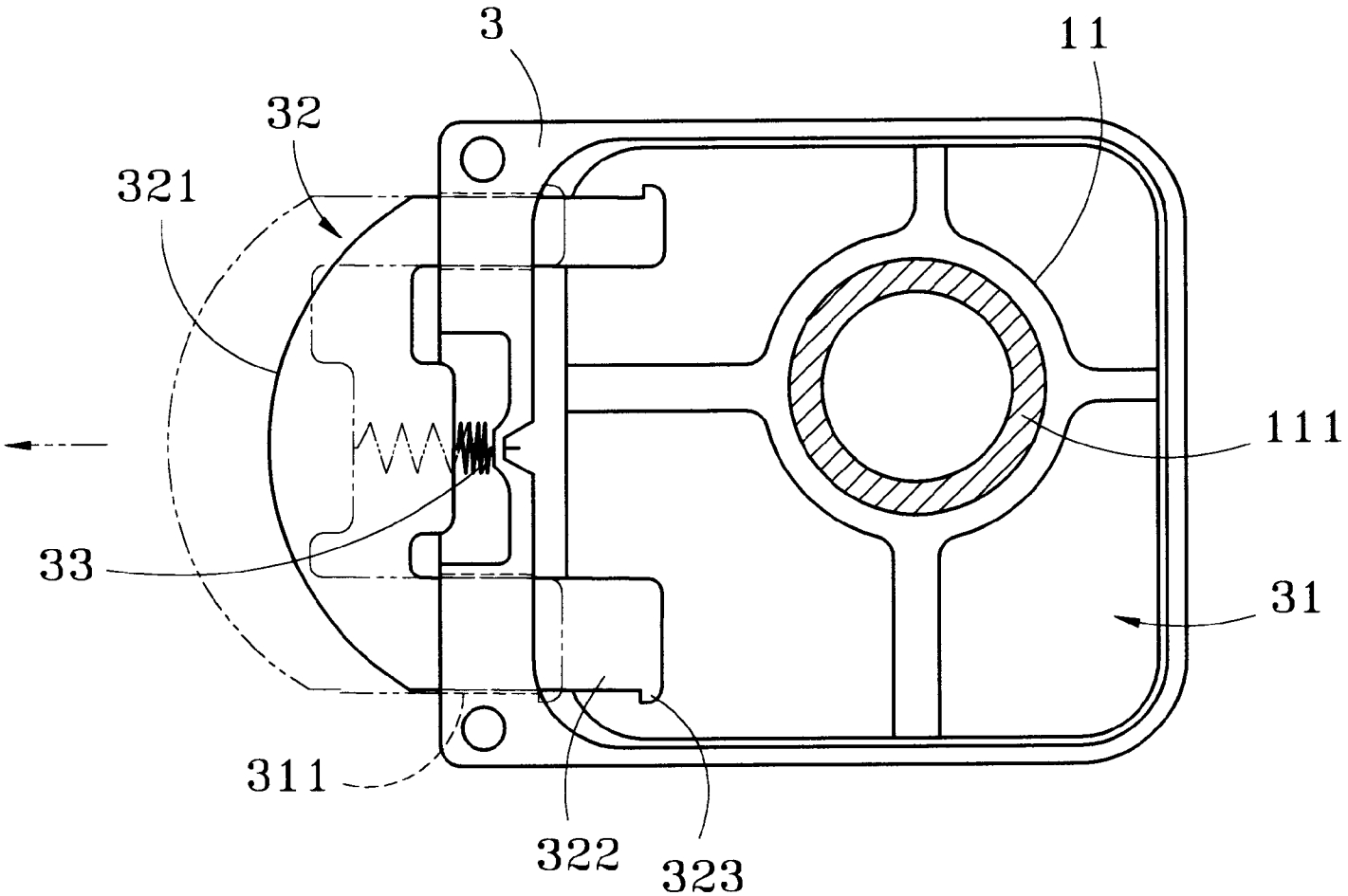
FIG. 5 is a fragmentary schematic view of an anchor seat of this invention.

Referring to FIGS. 2, 3 and 5, this invention aims at making a folding chair 1 convertible to a rocking chair. The folding chair 1 includes pedestals 11, 12, 13 and 14 located at four ends each has support bars 111, 112, 113 mounted thereon and coupled with armrests 17 at two sides for forming a chair frame. Then a backrest 15 and seat pad 16 may be disposed on the chair frame to form the final folding chair 1. Beneath the folding chair 1, there are a pair of rockers 2 and 2' which have respectively four anchor seats 3, 4, 5 and 6 fastened thereon through fasteners 34 for holding the leisure chair 1 on the rockers 2 and 2' to form a rocking chair.

Figure 4:
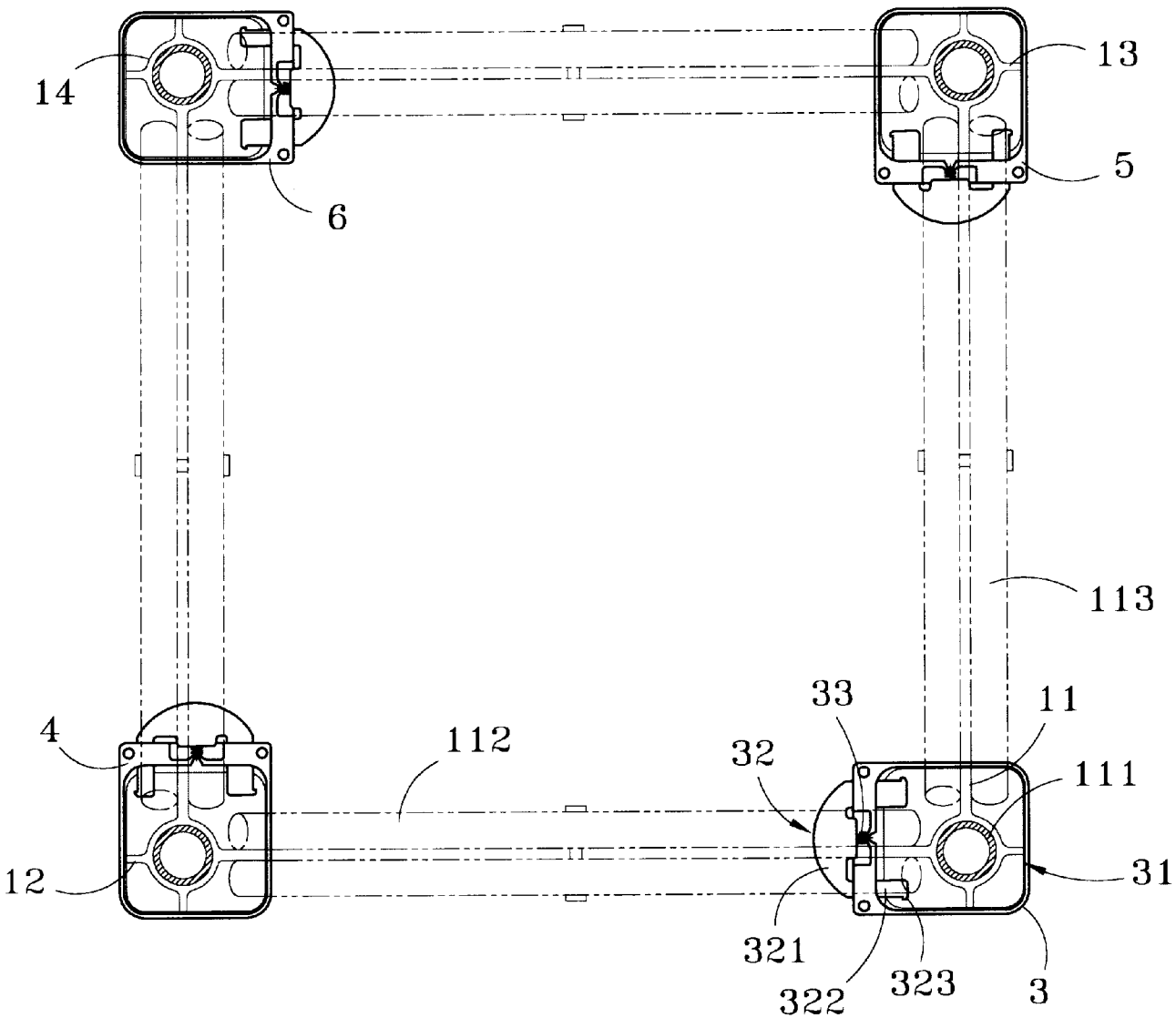
FIG. 4 is a schematic top view of this invention.

The rockers 2 and 2' are made of metallic bars formed in a curved shape and are fastened together by a bolt 21. The anchor seats 3, 4, 5, and 6 have respectively a housing chamber 31 for housing the pedestals 11, 12, 13 and 14. The housing chamber 31 has an opening 311 formed at one side for accommodating a retainer 32 which is to prevent the pedestal 11, 12, 13 and 14 from detaching from the anchor seat. The retainer 32 has a latch handle 321 and an elastic element 33 located between the latch handle 321 and anchor seat 3, 4, 5, and 6. The latch handle 321 has two ends extended through the opening 311 to form two constraint arms 322 in the housing chamber 31 at an upper portion thereof Each constraint arm 322 has a lug 323 extended sidewards at one end. Referring to FIG. 4, the constraint arm 322 may have different dimensions for mating and engaging with the support bars 111, 112, and 113 to form a strong cross connection for providing an even and stronger support of the load that might fall on the chair. The anchor seats 3, 4, 5, and 6 may be arranged in clockwise (or counterclockwise) direction at four ends to engage with the pedestals 11, 12, 13 and 14 for mating against the support bars 111, 112 and 113. The retainers 32 are located respectively at one side of the pedestal 11, 12, 13 and 14. Hence the folding chair 1 has an evenly distributed loading support without tilting to any side when seated, and the pedestals will be held securely without breaking away to ensure seating safety.

Referring to FIG. 5 for assembly or disassembly of this invention, when in an occasion where using of the rockers 2 and 2' is not desirable (such as on a slope ground, graveled road, or the like) and to remove the rockers 2 and 2' is needed, pull the latch handle 321 outwards, the constraint arms 322 will be moved outwards through the opening 311 and moved away from the pedestals 11, 12, 13 and 14, but still have one end remained in the housing chamber 31 because of the lug 323 stopping by the side wall of the anchor seats 3, 4, 5 and 6, and the elastic element 33 will be compressed. At this state, the pedestals 11, 12, 13 and 14 are free to move away from the housing chamber 31 so that the leisure chair 1 may be placed on the ground without the rockers 2 and 2'.

When converting the leisure chair 1 to a rocking chair is desired, repeat the foregoing procedures, pull the retainer 32 outwards, dispose the pedestals 11, 12, 13 and 14 in the anchor seats 3, 4, 5, and 6. When the pulling force on the latch handle 321 is released, the restoring force of the elastic element 33 will push the constraint arms 322 into the housing chamber 31 over the pedestals 11, 12, 13 and 14 thereby to prevent the pedestals from disengaging from the anchor seats 3, 4, 5 and 6. Thus the leisure chair 1 may be converted to a rocking chair. While the preferred embodiment of the invention has been set forth for purpose of disclosure, modifications of the disclosed embodiment of the invention as well as other embodiments thereof may occur to those skilled in the art. Accordingly, the appended claims are intended to cover all embodiments which do not depart from the spirit and scope of the invention.

What is claimed is:

1. A folding chair convertible to a rocking chair comprising:

(a) four pedestals, each pedestal having a plurality of support bars mounted thereon to form a foldable chair frame for supporting a backrest and a seat pad thereon;

(b) a pair of rockers, each rocker having two anchor seats for detachable engagement with two of the four pedestals and converting the folding chair into a rocking chair;

(c) each anchor seat including a housing chamber having an opening formed at a side thereof for receiving a retainer to prevent detachment of the pedestal from the anchor seat; and (d) each retainer included a latch handle and an elastic element disposed between the latch handle and the anchor seat, the latch handle having a pair of ends extended to define a pair of constraint arms passing through the opening and into the housing chamber at an upper portion thereof.

2. The folding chair of claim 1 wherein each constraint arm includes an outwardly extended lug.

3. The folding chair of claim 1, wherein each anchor seat is secured to the rocker by a fastener.

* * * * *